United States Patent [19]

Zimmer

[11] 4,055,612

[45] Oct. 25, 1977

[54] TREATING OF TRAVELLING WEBS

[76] Inventor: Peter Zimmer, Untere Sparchen 54, A 6330 Kufstein (Tirol), Austria

[21] Appl. No.: 532,250

[22] Filed: Dec. 12, 1974

Related U.S. Application Data

[63] Continuation of Ser. No. 332,275, Feb. 14, 1973, abandoned.

[30] Foreign Application Priority Data

Feb. 15, 1972 Austria ..... 1206/72

[51] Int. Cl.[2] ..... B65H 25/26

[52] U.S. Cl. ..... 264/40.7; 264/288; 26/75; 26/106; 226/1; 242/57.1

[58] Field of Search ..... 226/19–23, 226/39, 195; 26/106, 51; 242/57.1; 264/40, 210, 288

[56] References Cited

U.S. PATENT DOCUMENTS

| | | | |
|---|---|---|---|
| 1,263,419 | 4/1918 | James | 242/75.2 |
| 2,753,591 | 7/1956 | Stevens | 26/106 X |
| 2,827,809 | 3/1958 | Beam | 226/19 |
| 3,188,063 | 6/1965 | Costakis | 226/20 X |
| 3,220,347 | 11/1965 | Luehrs | 101/179 |
| 3,222,895 | 12/1965 | Sheppard | 68/5 |
| 3,602,191 | 8/1971 | Gorton | 226/22 X |
| 3,744,106 | 7/1973 | Baum | 26/106 |

*Primary Examiner*—Richard A. Schacher
*Attorney, Agent, or Firm*—Michael J. Striker

[57] ABSTRACT

Relatively inflexible travelling webs, such as carpets or rugs having a coating on the reverse side thereof, are guided in a convoluted path around a plurality of guide rollers, and in this path they are heated by being subjected to steam heat, hot air heat, heat-producing radiation or heat derived from other sources.

12 Claims, 1 Drawing Figure

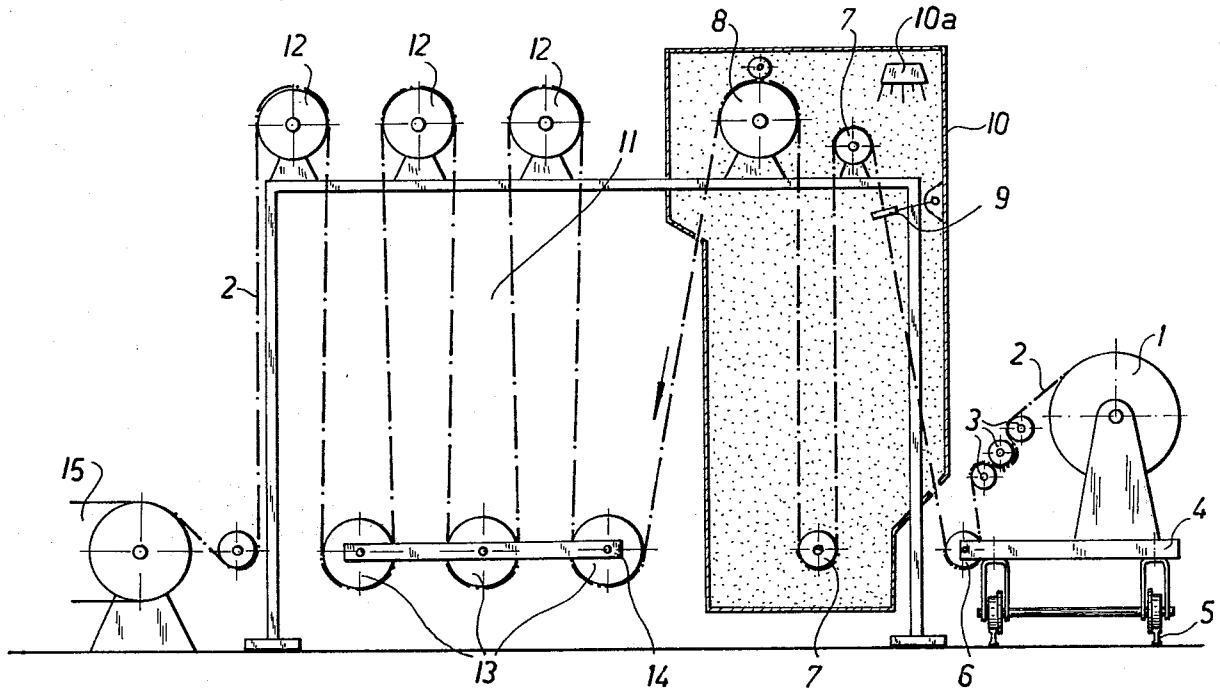
1
2
3
4
5
6
7
7
8
9
10
10a
11
12
12
12
13
14
15
2

TREATING OF TRAVELLING WEBS

This is a continuation of application Ser. No. 332,275, filed Feb. 14, 1973, and now abandoned.

BACKGROUND OF THE INVENTION

The present invention relates generally to the treating of travelling webs, and more particularly to the treating of webs which are relatively inelastic, for instance carpets or rugs whose reverse side is coated with rubber or the like.

There are many instances where webs, such as rugs, carpets or the like, must undergo treatment in an apparatus. This is true for instance when the web is to printed, if it is to be dyed, if it is to be cut or otherwise processed. In such instances it is necessary not only to maintain the web under requisite tension as it undergoes the treatment, but also to control its appropriate positioning in the machine, that is to control the location of its edges with respect to the apparatus through which it travels. This is required in order to compensate for tension variations, to avoid uneven pulling on the web that could cause it become distorted, to prevent uneven winding-up of the web, and for similar reasons. From the prior art it is known to provide devices using regulating rollers which so control the position of the web transeversely to its direction of advancement that the edges—and thereby the longitudinal centerline of the web—are maintained in a certain relationship in the apparatus.

It is also known to utilize a different approach, avoiding the guidance rollers which extend over the entire width of the web and replacing them with edge guides which serve to urge the edges of the web to the desired position.

The trouble with both of these prior-art constructions is that there is a danger that folds may fold in the web, due to the lateral shifts caused in the web by the control elements. This is particularly true if the web is relatively inelastic, such as is for instance the case with rugs or carpets having a coating on the reverse side, usually latex or foam rubber.

SUMMARY OF THE INVENTION

Accordingly, it is a general object of the invention to overcome the disadvantages of the prior art.

More particularly it is an object of the invention to provide an improved apparatus for treating of webs, especially those which are relatively inflexible, and which avoids the aforementioned disadvantages.

Another object of the invention is to provide such an apparatus which is relatively uncomplicated and reliable in its operation.

In keeping with these objects, and with others which will become apparent hereafter, one feature of the invention resides, in an apparatus for treating webs which are relatively inflexible, in a combination comprising guide means guiding the webs for movement in a predetermined path, and heating means for heating the webs in this path.

During the travel in the predetermined path the webs are subjected to a certain amount of tensioning and stretching. The heating can be carried out in any one of many suitable ways. It is possible to use hot steam, saturated steam, hot air, infrared radiation, heat-producing short-wave radiation or a gas-burning device to produce the heat. In any case, the purpose is to make the webs more readily stretchable in contradistinction to their inherent relative inflexibility, and this assures that even if the web has to undergo substantial movements transversely of its path, movements which are occasioned by the guiding elements which keep the web centered, there is little or no danger that folds might form in the web.

The novel features which are considered as characteristic for the invention are set forth in particular in the appended claims. The invention itself, however, both as to its construction and its method of operation, together with additional objects and advantages thereof, will best be understood from the following description of specific embodiments when read in connection with the accompanying drawing.

BRIEF DESCRIPTION OF THE DRAWING

The single FIGURE is a diagrammatic side-elevational view illustrating one possible embodiment of the invention.

DESCRIPTION OF THE PREFERRED EMBODIMENTS

Reference numeral 1 in the drawing identifies a supply roll from which the web 2, which may be a rug, carpet or the like, is withdrawn via a braking arrangement 3. The web travels towards the left in the drawing, as indicated by the arrow. The supply roller 1 is mounted on a separate carriage 4 which can be shifted on the rails 5 transversely of the direction of travel of the web. A control arrangement, not illustrated in the drawing and not forming part of the invention, is provided for this purpose.

A reversing roller 6 is also mounted on the carriage 4, and the web after passing through the braking arrangement 3, is trained about the roller 6 and enters the apparatus where it is trained about segmented guide rollers 7 until it reaches a withdrawing roller 8. It passes about the withdrawing roller 8, through a nip defined by the same and a cooperating pressure roller, one of these being driven, and is thus withdrawn from the supply roller 1. With this arrangement the web 2 is subjected to longitudinal tension intermediate the roller 8 and the braking arrangement 3; the braking arrangement is adjustable as to the resistance it offers to the withdrawal of the web 2, so as to permit varying of this tension.

An edge feeler 9 contacts the edge of the web and senses when the position of the edge deviates from the desired position; when such a deviation occurs the carriage 4 is moved on the rails 3 until the deviation has been eliminated. During this movement a shifting will of course occur in the web and there is the danger that folds might form in the web, particularly if the same is relatively inelastic as is the case with rugs or carpets, especially those which are coated on the back. This is understandable because, although depending upon the direction in which the web is moved off-center one side of the web continues to be under longitudinal tension, the other side will relax with the result that it tends to form folds.

The invention overcomes this problem by providing the arrangement 10 which surrounds the entire path or region in which the position of the edges of the web is controlled and in which the web is subjected to longitudinal tension. This makes it possible to heat the web in this area and to thereby cause a substantial increase in the extent to which it can be stretched in longitudinal direction so that even quite substantial transverse movements of the web for centering purposes can be carried out without any formation of folds in the web and without having to subject the web to impermissibly high longitudinal tension.

Within the arrangement 10 I have diagrammatically illustrated a single heating device 10*a*, but it should be understood that more than one such heating device can be provided and that the single or several heating devices can be located within the arrangement 10, that is the housing surrounding the area in question, wherever this is determined to be necessary or advantageous. The heating device 10*a* is to be representative of any suitable heating arrangement, such as a device for discharging hot or saturated steam, for discharging hot air, for emitting infrared radiation or heat-producing short waves, a gas burner or the like. All of these heating means are too well known to require detailed discussion.

Downstream of the arrangement 10 the web 2 is advanced to a storage arrangement 11 having upper rollers 12 and lower rollers 13 about which the web is trained in a convoluted path as illustrated. The lower rollers 13 are mounted on a transverse support which is movable in vertical direction. The arrangement here is to permit a storage of web and thus to make possible an uninterrupted operation of the subsequently following printing machine 15 (diagrammatically shown) whenever the supply roller 1 must be changed, in which case the movement of the web 2 between the braking arrangement 3 and the withdrawing roller 2 is of course terminated for the duration of this change, via the braking arrangement 3 and/or the roller 8.

The present invention has the additional advantage that, if the web is a carpet or a rug, heating thereof causes the fibers to be particularly well able to accept printing ink in the machine 15, and the nap is also raised on the carpet which affords an advantageous increase in the accuracy of the contour of the printed matter to be applied in the machine 15.

Naturally, the position of the edges of the web can be controlled in ways other than by the movable carriage 4, and in fact with any means well known in the art per se. Also, the arrangement according to the present invention need supply the web to a printing machine, but can be used in other circumstances, for instance to supply the web to an arrangement wherein it is to be dyed or the like.

It will be understood that each of the elements described above, or two or more together, may also find a useful application in other types of constructions differing from the types described above.

While the invention has been illustrated and described as embodied in the treating of travelling webs, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting essential features of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an apparatus for printing relatively inelastic textile webs whose longitudinal edges are required to travel in a predetermined path through a printing station, a combination comprising textile web supplying means; driven roller means for pulling the web off from the supply means and for forwarding said web to said printing station with said longitudinal edges in position to travel in said predetermined path; retarding roller means upstream of said driven roller means for retarding the web so that the web is subjected to longitudinal tensioning intermediate said driven roller means and said retarding roller means; edge feeler means located between said driven roller means and said retarding roller means for sensing whether one edge of the web deviates from said predetermined path; means mounting said supply means movable in a direction transverse to the longitudinal direction of said path and cooperating said feeler means for shifting said supply means in said transverse direction when said edge feeler means senses deviation of said one edge from said predetermined path, to thus return said edge to said predetermined path; and heating means for heating the web along a major portion thereof between said driven roller means and said retarding roller means to enhance the stretchability of said portion of said web to avoid fold formation during lateral shifting of said supply means.

2. A combination as defined in claim 1, wherein said heating means comprises a device for discharging hot steam.

3. A combination as defined in claim 1, wherein said heating means comprises a device for discharging saturated steam.

4. A combination as defined in claim 1, wherein said heating means comprises a device for discharging hot air.

5. A combination as defined in claim 1, wherein said heating means comprises infra-red radiating means.

6. A combination as defined in claim 1, wherein said heating means comprises short-wave radiating means.

7. A combination as defined in claim 1, wherein said heating means comprises a gas-burning heater.

8. A combination as defined in claim 1, and including a housing enclosing said major portion of said web, said heating means being located in said housing.

9. A combination as defined in claim 8, wherein said web supply means is a reel, and said mounting means is a carriage movable in said transverse direction, said reel and said retarding roller means being mounted on said carriage.

10. A combination as defined in claim 9, wherein said housing is an elongated substantially vertically extending housing, said driven roller means being mounted in an upper portion of said housing, and including a reversing roller on said carriage, a first guide roller mounted in said housing for rotation about a fixed axis adjacent to said driven roller means, a second guide roller in a lower portion in said housing, said web being successively guided from said reversing roller over said first guide roller and said second guide roller to said driven roller means to leave said housing downstream of said driven roller means.

11. A combination as defined in claim 8, and including storage means downstream of said housing, said storage means including a plurality of upper guide rolls mounted for rotation about fixed parallel axes spaced normal to the longitudinal direction of their axes from each other, and a plurality of lower guide rollers connected transversely spaced from each other to each other for movement in vertical direction and having axes parallel to those of the upper guide rollers for guiding the web between said driven roll means and the printing apparatus along a zig-zag path.

12. A method for forwarding a relatively inelastic textile web from a web supply toward a printing station at which the longitudinal edges of the web are required to travel along a predetermined path, comprising the steps of moving the web in longitudinal direction under tension from the supply means along said predetermined path towards said printing station; moving the supply means in a direction transverse to said longitudinal direction if the web deviates from said predetermined path; and heating a major portion of the tensioned web to enhance its stretchability to avoid fold formation during movement of the web in said transverse direction.

* * * * *